United States Patent [19]

Burns et al.

[11] Patent Number: 4,547,032

[45] Date of Patent: Oct. 15, 1985

[54] LOCKING MEANS FOR A PLUG AND RECEPTACLE ELECTRICAL CONNECTOR

[75] Inventors: Edgar A. Burns, Los Angeles; James W. Johnson, North Hollywood, both of Calif.

[73] Assignee: Automation Industries, Inc., Greenwich, Conn.

[21] Appl. No.: 637,545

[22] Filed: Aug. 3, 1984

[51] Int. Cl.[4] ..... H01R 13/625

[52] U.S. Cl. ..... 339/90 R; 339/DIG. 2

[58] Field of Search ..... 339/89 R, 89 C, 89 M, 339/90 R, 90 C, DIG. 2; 285/82, 87, 88

[56] References Cited

U.S. PATENT DOCUMENTS

| | | | |
|---|---|---|---|
| 4,066,315 | 1/1978 | Arneson | 339/89 M |
| 4,264,116 | 4/1981 | Gliha, Jr. | 339/90 R |
| 4,290,662 | 9/1981 | Storcel | 339/89 M |
| 4,362,349 | 12/1982 | Gallusser et al. | 339/89 M |
| 4,457,469 | 7/1984 | Ratchford | 339/89 M |
| 4,457,572 | 7/1984 | Frazier et al. | 339/89 M |
| 4,478,473 | 10/1984 | Frear | 339/89 M |

*Primary Examiner*—John McQuade

*Attorney, Agent, or Firm*—Thomas L. Flattery

[57] ABSTRACT

A connector has a coupling ring received about a plug shell, the inner wall surfaces of the coupling ring having a coded arrangement of keyways to insure proper mating with similar coded keys on a proper receptacle. An opening in the coupling ring slidingly receives a metal ball. A notch is formed in a surface of a detent spring arranged such that when the plug shell and receptacle shell are fully mated, the ball is aligned with and can move into a notch in the detent spring. A retainer ring located over the coupling ring lies immediately opposite the opening containing the metal ball. The inner surface of the retainer ring has a groove which on receiving the ball leaves no obstructing part of the ball extending inwardly of the coupling ring. Rotation of the retainer ring can locate either the groove opposite to the metal ball opening or a smaller diameter surface which will cause the ball to lock the connector parts.

7 Claims, 11 Drawing Figures

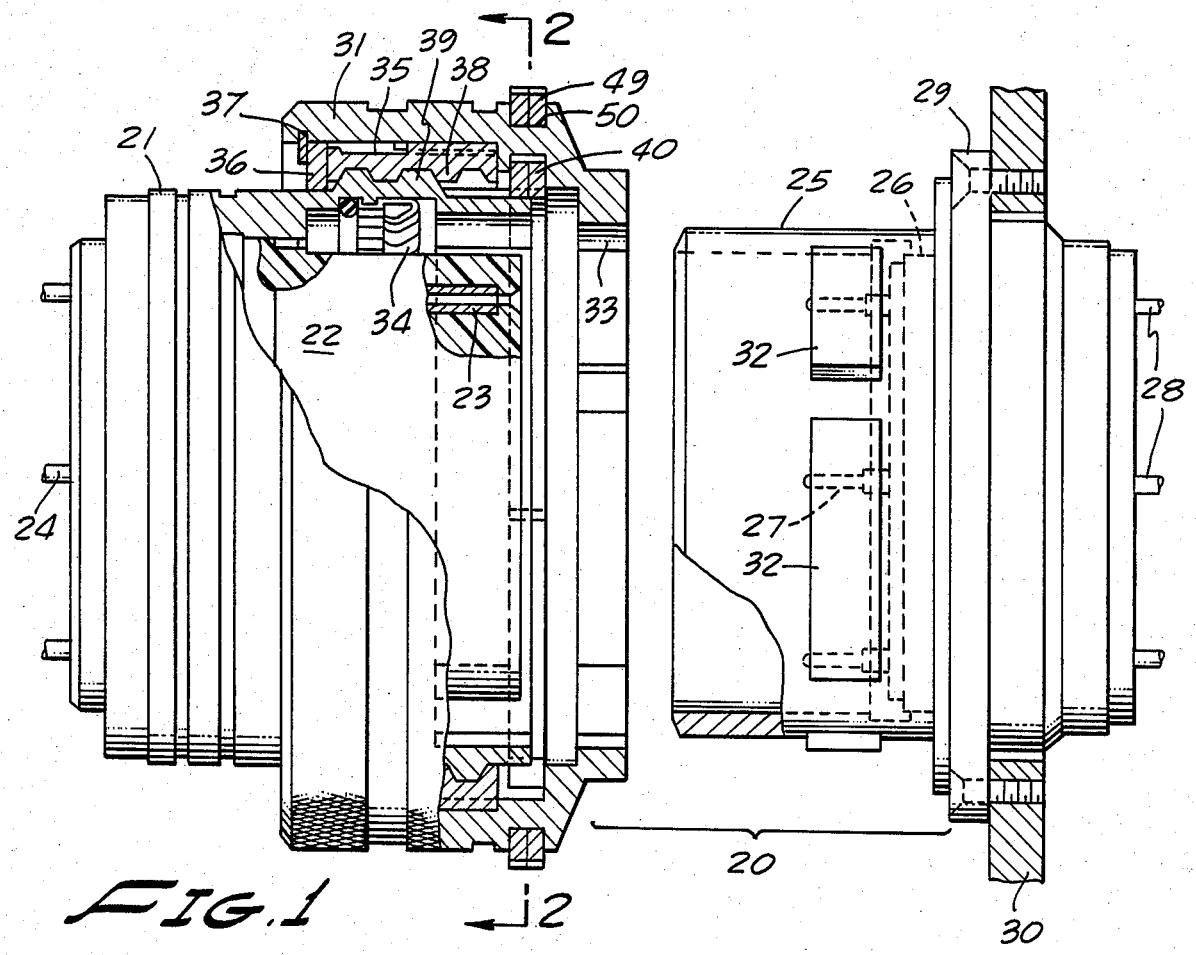
FIG. 1
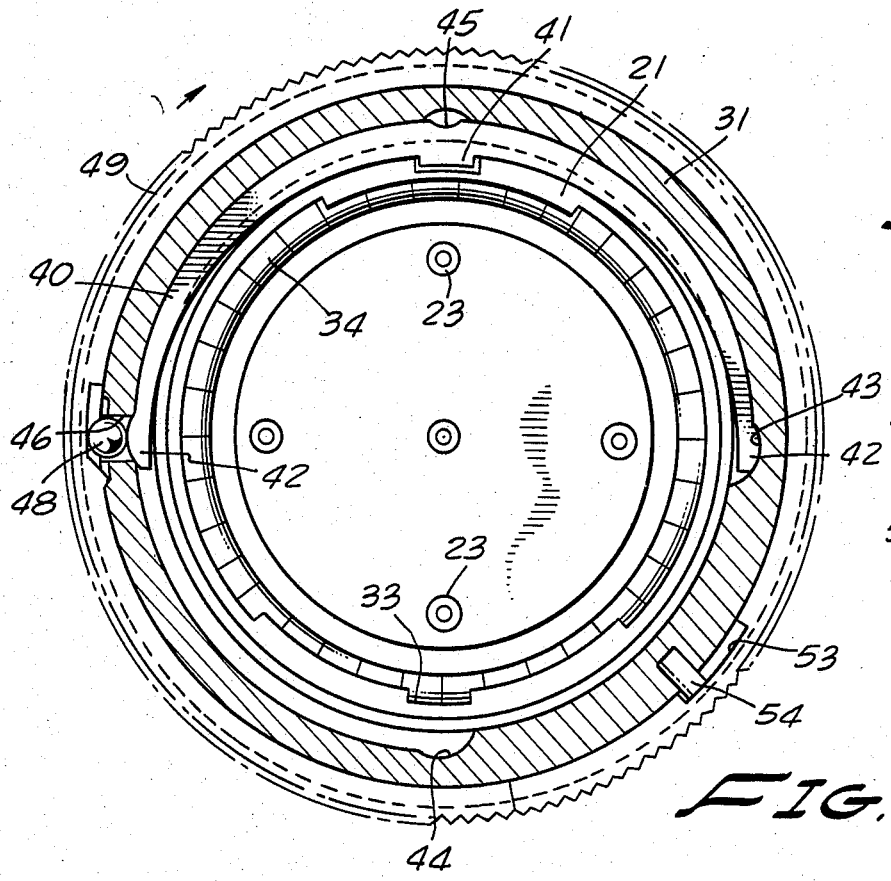
FIG. 2
FIG. 3
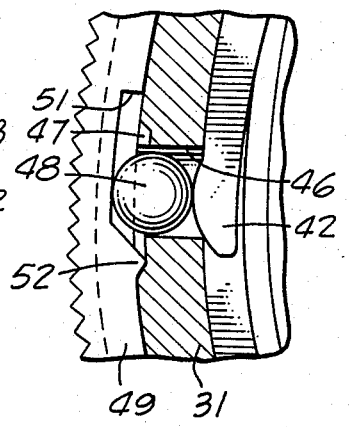

FIG. 6.
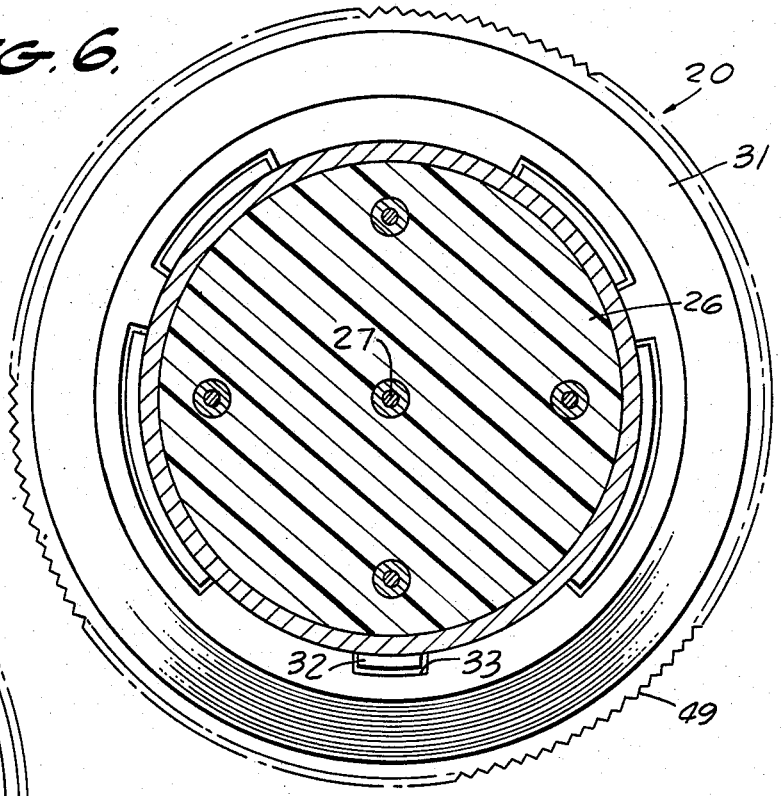
FIG. 7
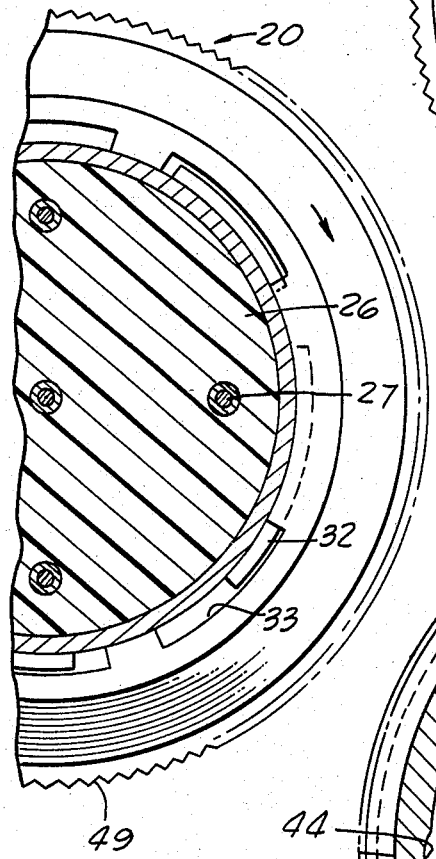
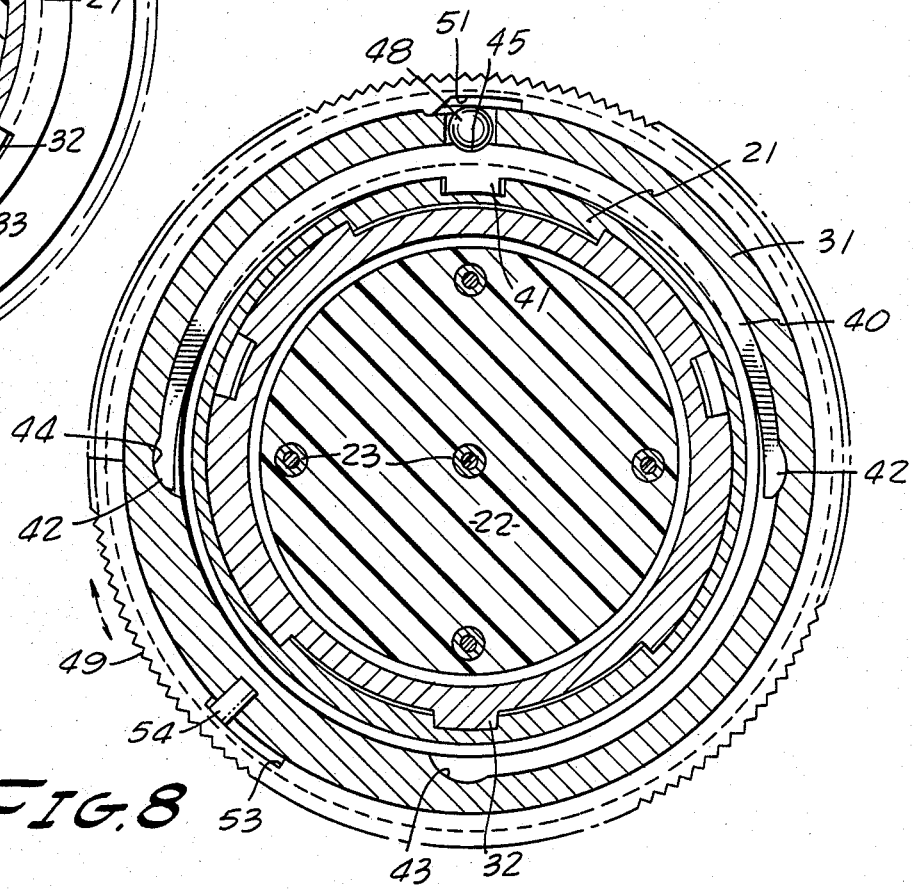
FIG. 8

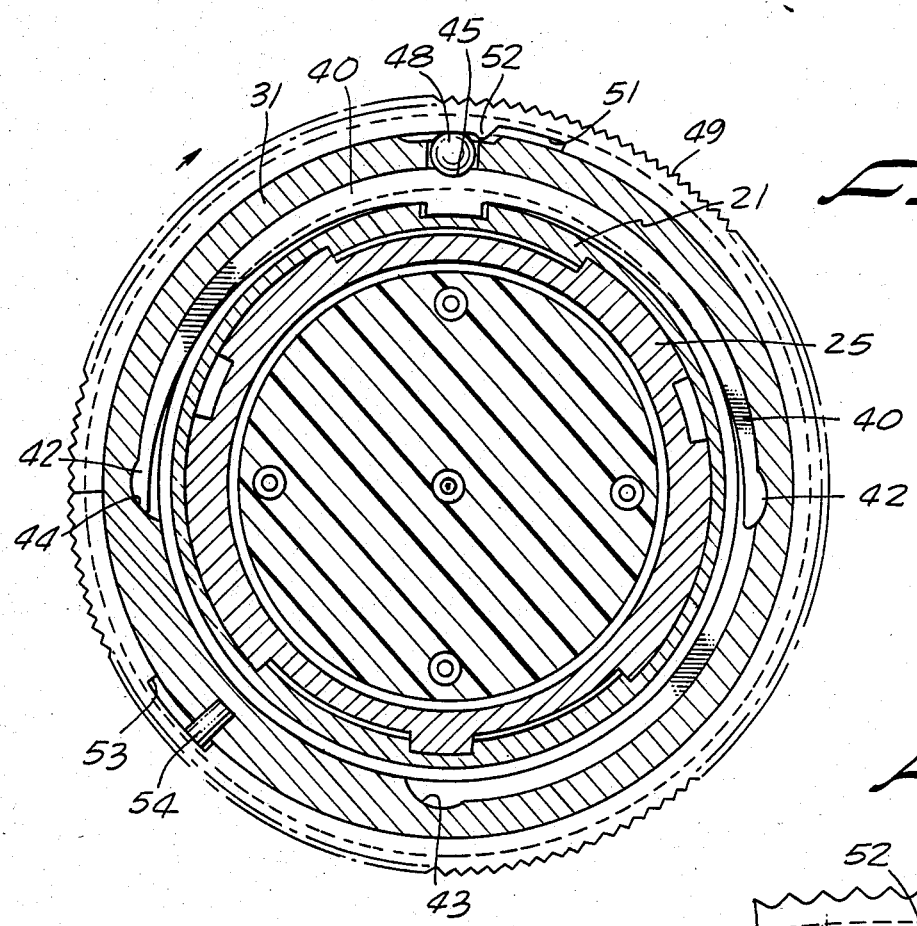
FIG. 9.
FIG. 10.
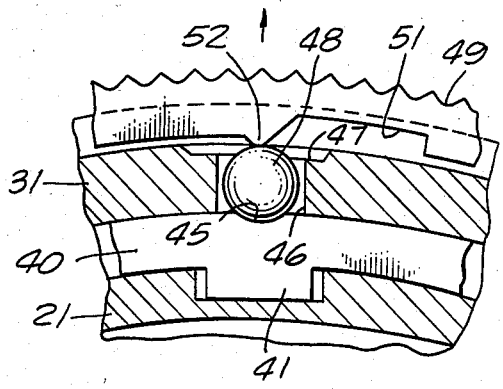
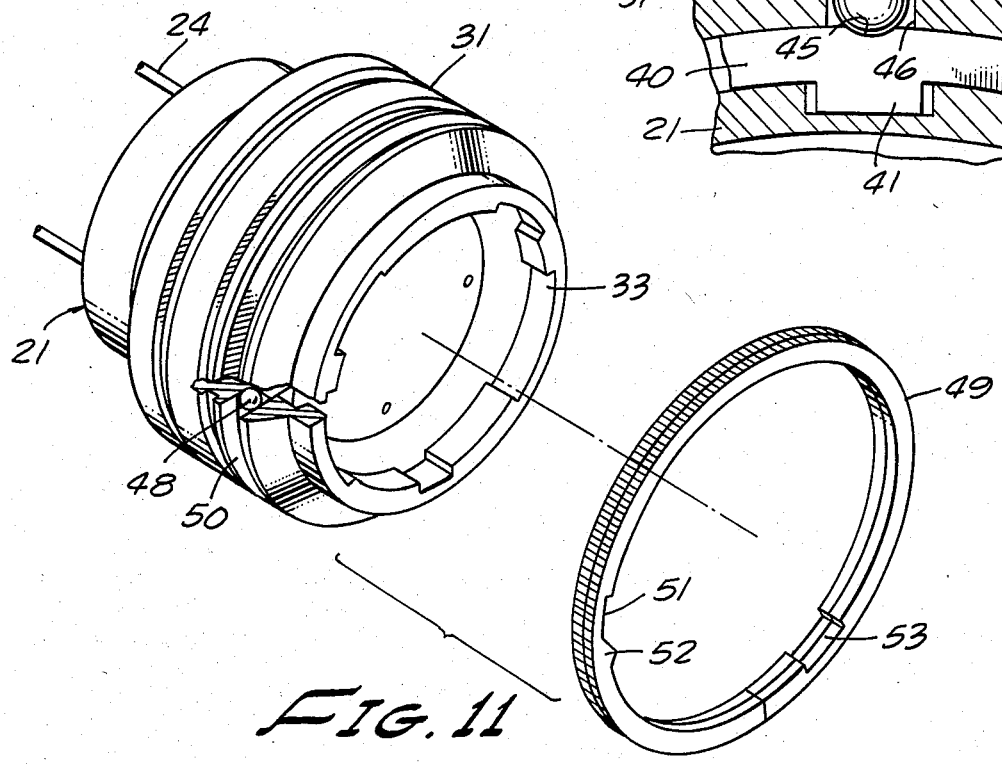
FIG. 11

LOCKING MEANS FOR A PLUG AND RECEPTACLE ELECTRICAL CONNECTOR

The present invention relates generally to an electrical connector having plug and receptacle parts which are releasably mated to one another, and more particularly, to a locking means for securing the connector parts in mated condition thereby preventing inadvertent release of the parts from one another.

BACKGROUND OF THE DISCLOSURE

A well received electrical connector is one which has parts that are releasably mateable together for establishing electrical connection between one or more electrical cable wires. Typically, this variety of connector includes plug and receptacle parts with a coupling ring or coupling housing mounted on the plug and rotatable to drive the plug and receptacle together or apart depending upon rotation direction.

U.S. Pat. No. 4,066,315, Electrical Connector With Arcuate Detent Means, issued Jan. 3, 1978, to Hal Arneson, discloses such a plug and receptacle connector having a detent and locking means which provides an aural and tactile indication. The patented indicting means also serves as a locking means which, although excellent for most purposes, is insufficient if the connector is subjected to relatively large shocks and vibrations.

SUMMARY OF THE DISCLOSURE

The connector with which the described locking means is most advantageous includes a coupling ring or housing received about a cylindrical plug shell, the inner wall surfaces of the coupling ring including a coded arrangement of keyways to insure proper mating with similarly coded keys on a proper receptacle. The inner wall surface of the coupling ring also includes an opening within which a metal ball is slidingly received.

A generally semi-circular detent spring is mounted onto the inner surface of the coupling ring and operates to snap into receiving recesses when the connector parts are fully mated and fully unmated. A notch is formed in the outer surface of the detent spring and the various parts are so arranged relative to one another that when the plug shell and receptacle shell are fully mated, the metal ball is aligned with and can move into the notch of the detent spring.

A retainer ring is located over the coupling ring and lies immediately opposite the opening within which the metal ball is received. The inner surface of the retainer ring as a limited groove which will allow the metal ball to extend outwardly of the coupling ring into the groove and therefore leaving no obstructing part of the bearing extending inwardly of the coupling ring. Rotation of the retainer ring can locate either the grooved portion opposite to the metal ball opening or a smaller diameter surface which will cause the ball to extend inwardly of the coupling ring for an obstructing and locking relation to be described.

In operation of the connector, the receptacle and plug shell are moved together and rotation of the coupling ring serves to pull the connector parts together into mating relation. When the parts are fully mated both a tactile and aural indication is indicated of the mating condition by the detent spring. To lock the parts together, the retainer ring which initially was located with the internal groove opposite the metal ball is now rotated to a position moving the ball inwardly of the coupling ring for receipt into the detent spring notch. When in this condition, the coupling ring and plug shell are locked together and cannot be rotated with respect to one another. To release or unlock the parts, the retainer ring is rotated once again to the position where the internal groove lies opposite the ball which releases it from the notch in the detent spring enabling rotation of the coupling ring with respect to the plug shell and thereby unmating the connector.

A projection or detent on the inner surface of the locking ring is forced to ride up and over the ball during locking action which provides a position indicating that locking has been achieved. Also, this detent prevents too easy or inadvertent release (i.e., unlocking).

DESCRIPTION OF THE DRAWING

FIG. 1 is a side elevational, partially sectional view of a plug and receptacle connector shown disconnected or unmated.

FIG. 2 is an end elevational, sectional view taken along the line 2—2 of FIG. 1.

FIG. 3 is an enlarged fragmentary view showing the locking means in released condition.

FIG. 6 is an end elevational, sectional view taken along the line 6—6 of FIG. 4.

FIG. 7 is a sectional view similar to FIG. 6 showing rotation of the coupling ring from the position of FIG. 6.

FIG. 8 is an end elevational, sectional view taken along the line 8—8 of FIG. 5 showing the connector mated but with the lock in released condition.

FIG. 9 is an end elevational, sectional view similar to FIG. 8 showing the connector mated but the locking means in locked condition.

FIG. 10 is an enlarged, sectional, fragmentary view of the locking means of FIG. 9 shown intermediate establishing the locked mode.

FIG. 11 is an exploded view of the plug shell connector part, coupling ring and retainer ring.

DESCRIPTION OF A PREFERRED EMBODIMENT

Figure 4:
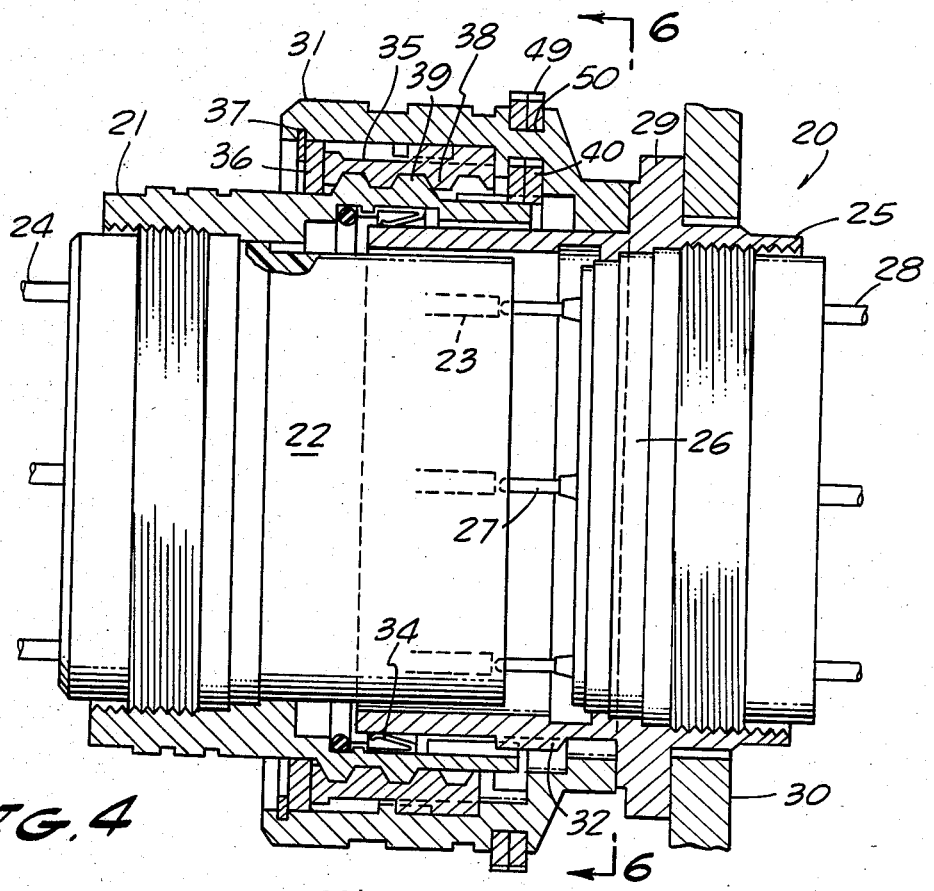
FIG. 4 is a side elevational, partially sectional view similar to FIG. 1 showing the connector parts in the initial stages of mating.
Figure 5:
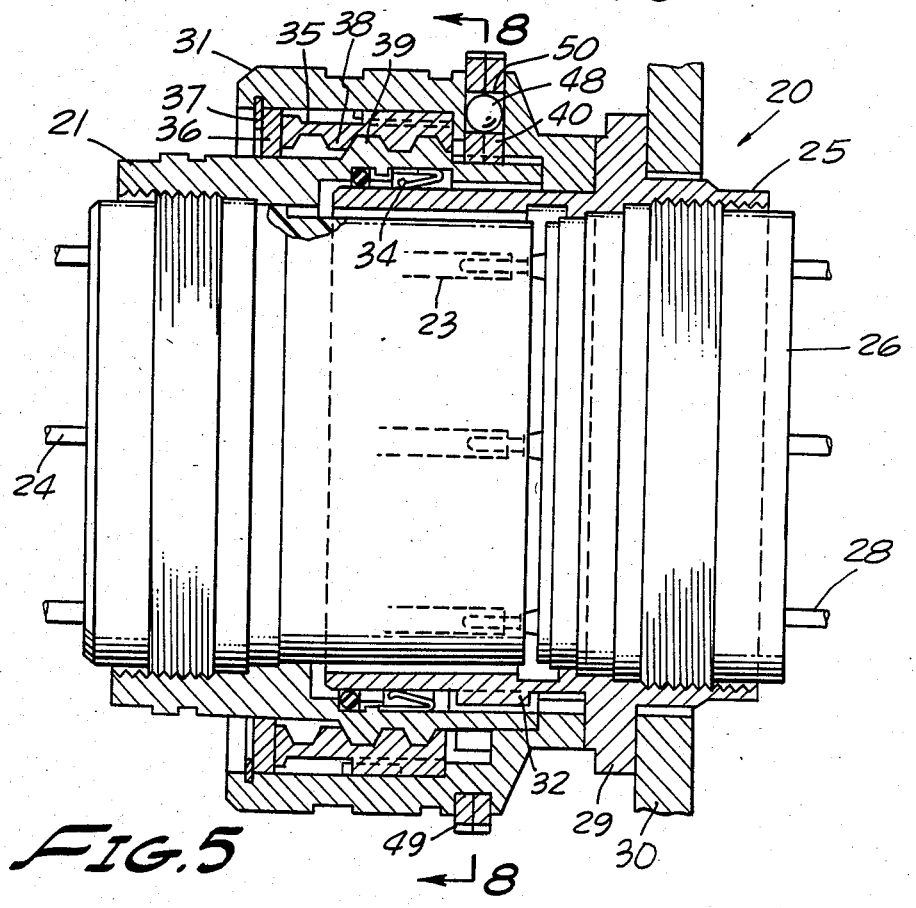
FIG. 5 is a sectional elevational view similar to FIG. 4 showing the connector parts fully mated and locked.

Attention is directed to the drawings and particularly to FIG. 1 in which an electrical connector 20 with which the locking means to be described is most advantageously employed. A plug shell 21 which is of generally hollow cylindrical form includes an insulative insert 22 having a plurality of socket contacts 23 (optionally, pin contacts) connected to a set of cable wires 24. A receptacle shell 25 similarly includes an insulative insert 26 in which is embedded a set of pin contacts 27 (optionally, socket contacts) which are connected to a further set of cable wires 28. Typically, a flange 29 is affixed to the shell 25 to serve as a means for mounting to a wall or panel 30, for example.

A hollow metal shell 31 referred to as a coupling ring is mounted on the plug shell 21 and rotatable with respect to the plug shell for mating and unmating of the connector parts depending upon the direction of rotation. To prevent against the possibility of mating an improper plug and receptacle to one another, a set of keys 32 are arranged in a coded manner on the receptacle shell outer surface for appropriate interfitting with a similarly set of coded keyways 33 located on the inner surface of the open end of the coupling ring and on the inner surface of the open end of the plug shell.

Turning once again to the plug shell 31 as shown in FIG. 1, it has an internal diameter at its front open end of such dimensions as to permit acceptance of the small diametral end of the receptacle shell 25 therewithin. A leaf-spring radiation shield 34 is formed into a ring about the insert 22 and serves as a means for closing off the end of the receptacle shell 25 as it is received in mating relation within the plug shell 21 to prevent access of external interference electromagnetic fields to the enclosed contacts.

The coupling housing 31 encloses a cylindrical nut 35 which is keyed within the coupling ring so as to rotate unitarily therewith. A ringlike wavy washer 36, for example, is received within the open end of the coupling ring 31 and engages the end of the nut 35 resiliently holding the same within the coupling ring. A retainer ring 37 secures the wavy washer and nuts within the coupling ring. The internal surface of the nut 35 includes a set of threads 38 which mesh with a similar set of threads 39 on the plug shell outer surface. By these threads, rotation of the coupling ring with respect to the plug shell axially advances or withdraws the connector parts depending on the direction of rotation.

As is more particularly described in the referenced U.S. Pat. No. 4,066,315, one or more generally semicircular detent springs 40 (FIG. 2) are provided, each having an inwardly directed key 41 received in a keyway on the outer surface of the plug shell 21. The ends of the detent spring are provided with projections 42 which snap into recesses 43 and 44 on the inner wall of the coupling ring 31, respectively, when the connector parts are released and when they are mated. This provides the tactile and aural indication desired. On the convex side of the detent spring directly opposite key 41, a groove 45 is provided for a purpose to be described.

Turning now to both FIGS. 2 and 3, the coupling ring is seen to include a radially directed passageway 46 which opens into an enlarged groove 47 at the outer or convex side of the coupling ring. A metal ball 48 is slidingly received within the passageway and of a diameter substantially exceeding the thickness of the coupling ring wall between the locking ring and the detent spring.

A locking ring 49 is a narrow-width cylindrical member capable of radial springlike expansion which slidingly fits into a groove 50 in the coupling ring outer surface directly opposite passageway 46. A circumferentially extending groove 51 on the locking ring inner surface can be brought into opposing relationship to the passageway 46 allowing the ball 48 to move therein.

Rotation of coupling ring the necessary amount to mate the connector parts also snaps one of the detent spring projections into recess 44, for a purpose already explained. At this same time, the ball 48 moves into the detent spring groove 45 (FIG. 8) where it loosely rests at this time.

To lock the connector in the mated position, the locking ring 49 is rotated moving the internal groove 51 beyond the passageway 46 as shown in FIG. 9. For this to occur, a detent 52 is forced to ride over the ball 48 which is enabled by radial springlike distension of the locking ring. Now, the inner surface of the locking ring contacts the ball holding it securely in the detent spring groove 45. In this manner, the coupling ring 31 is unitarily related via the detent spring to the plug shell 21 preventing adjustive rotation between the two.

Release of the locking means is effected by rotating the locking ring from the position shown in FIG. 9 to that of FIG. 8 with the groove 51 freeing the spherical bearing from its locking engagement.

On either locking or releasing the locking means, the detent 52 on the locking ring 49 at the edge of groove 51 provides a positive indication of the change of mode and also prevents easy or inadvertent unlocking.

Rotation of the coupling ring 31 about the plug, either to mate or unmate the connector parts, simultaneously unitarily rotates the locking ring. 49. However, since the locking ring and coupling ring do not change their position relative to one another during coupling ring rotation, the locking means mode remains unchanged. It is only rotation of the locking ring with respect to the coupling ring that produces locking and unlocking.

To insure ready locking and unlocking without the need for excessive turning of the locking ring 49, rotation limit means are provided. More particularly, a second recess 53 of prescribed circumferential length is formed on the inner surface of the locking ring into which one end of a pin 54 secured to the coupling ring extends. In this manner, the locking ring 49 has a total path of adjustable rotation with respect to coupling ring that is equal to the circumferential length of second recess 53.

We claim:

1. Locking means for an electrical connector having a receptacle, a plug, a coupling ring shell threaded on the plug which on rotation moves the plug and receptacle toward or away from each other depending upon the direction of rotation, a generally semicircular detent spring fixedly located on the outer surface of the plug and including projections which snap into recesses on the inner wall of the coupling ring shell when the receptacle and plug are fully mated and unmated, said detent spring having a groove on its outer convex surface, comprising:

the coupling ring shell having an opening extending therethrough which aligns with substantially the midpoint of the detent spring when the plug and receptacle are mated;

a locking ring received on said coupling ring shell and rotatable thereabout while fixedly located along the coupling ring shell longitudinal axis, said locking ring inner surface lying over the coupling ring shell opening throughout the full range of rotation and including a first recess which can be aligned with said coupling ring shell opening; and means slidably received within the coupling ring shell opening of such dimensions as to have a portion thereof forced into the detent spring groove by the locking ring inner surface adjacent the locking ring first recess on the coupling ring shell opening being aligned with the detent spring groove.

2. Locking means as in claim 1, in which the locking ring has radially inwardly projecting means at an edge of the locking ring first recess, said locking ring being resilient such that on rotation of the locking ring moving the projecting means over the slidable means this provides a tactile and aural indication.

3. Locking means as in claim 1, in which the locking ring inner surface includes a second recess which extends a predetermined distance circumferentially of the coupling ring shell, and pin means affixed to the coupling ring shell outer surface and having a portion received within the second recess.

4. Locking means as in claim 1, in which the slidable means includes a metal ball.

5. Locking means as in claim 1, in which the outer surface of the coupling shell immediately adjacent the opening therein includes a recess for receiving the projecting means therein.

6. Locking means as in claim 5, in which the dimensions of the slidable means are such that when located within the detent spring groove, rotation of the locking ring first recess past the coupling ring shell opening causes the projecting means to move up onto and over the slidable means distending the locking ring.

7. Locking means as in claim 1, in which a second recess is formed in the inner surface of the locking ring, and pin means affixed to the coupling ring shell have a part thereof extending into the second recess.

* * * * *